United States Patent [19]

Chang

[11] Patent Number: 4,640,428

[45] Date of Patent: Feb. 3, 1987

[54] HIGH GAS BARRIER PLASTIC CLOSURE

[75] Inventor: Long Fei Chang, Sylvania, Ohio

[73] Assignee: Owens-Illinois, Inc., Toledo, Ohio

[21] Appl. No.: 772,277

[22] Filed: Sep. 3, 1985

[51] Int. Cl.[4] ..... B65D 53/04

[52] U.S. Cl. ..... 215/270; 215/347; 215/351

[58] Field of Search ..... 215/270, 349, 351, 347, 215/341

[56] References Cited

U.S. PATENT DOCUMENTS

| | | | |
|---|---|---|---|
| 1,978,946 | 10/1934 | Horner | 215/270 |
| 4,122,964 | 10/1978 | Morris | 215/349 |
| 4,390,552 | 6/1983 | Niwa | 215/349 X |
| 4,564,117 | 1/1986 | Herbert | 215/351 |

FOREIGN PATENT DOCUMENTS

| | | | |
|---|---|---|---|
| 2302929 | 10/1976 | France | 215/351 |

*Primary Examiner*—Donald F. Norton
*Attorney, Agent, or Firm*—John R. Nelson

[57] ABSTRACT

A plastic closure system for containers or bottles containing liquids under pressure, such as carbonated soft drinks. A liner incorporating a high gas barrier material such as "Eval" in a relatively thin layer is positioned over the end of the container neck. The liner is mechanically designed to have increased sealing forces applied thereto due to the internal pressure acting against the liner. In one embodiment, an overcap mechanically biases the liner over the edge of the container finish with internal gas pressure acting in the opposite direction, thus increasing the sealing force. The other embodiments incorporate a seal that has an annular, enlarged edge that is trapped between the finish and cap with pressure increasing the sealing force.

10 Claims, 5 Drawing Figures

HIGH GAS BARRIER PLASTIC CLOSURE

BACKGROUND OF THE INVENTION

Molded plastic closures for pressure containing containers, such as soft drink bottles, have become prevalent and are in greater use in recent times.

For example, U.S. Pat. No. 4,016,996 to Aichinger et al, issued Apr. 12, 1977, discloses a plastic closure that is threaded on a narrow neck container. This closure has a cylindrical seal part that is intended to seal against the neck of the bottle and to prevent loss of gas from the container.

This and other plastic closures have experienced three common problems, the first of which is that they tend to "dome" upwardly due to the internal gas pressure exerting itself beneath the center of the cap. This doming of the cap has, in some instances, created cracks in the cap, resulting in leaking of gases or liquids from the container.

The "doming" may cause the seal to be pulled away or shifted on the container neck after initial sealing, resulting in the leaking of either gases or liquids from the container.

Most plastics, unless they are extremely thick, have a tendency to "creep" over a period of time under stress and, in the case of plastic closures for carbonated beverages, there is a fairly high degree of internal pressure being exerted on the underside of the cap. Thus, when "creep" may occur, there is a good possibility that the carbonation will not be maintained.

Another problem associated with the use of plastics in the bottling of carbonated beverages is the gas permeability of the plastics. While some plastics have very good gas barrier properties such as "Eval", an ethylene vinyl acetate resin produced by E. I. DuPont de Nemours, they are relatively expensive and therefore it is less desirable to use them in the large quantities that would be used in beverage bottle applications.

It is known that gas permeation through a plastic closure can contribute to as much as 6%–8% of the gas loss in the typical plastic closure-plastic bottle combination. In those cases where the plastic closures were used with a glass container, essentially all of the gas losses would be through the closure.

SUMMARY OF THE INVENTION

Therefore, it is an object of the present invention to provide a plastic closure system for a pressurized container in which the closure has low gas permeability and the ability to withstand high pressure over an extended period of time. The closure of the invention comprises a plastic cap with a liner that has, as one element thereof, a gas barrier layer and is configured to prevent leakage under stress and enhance the ability of the closure to contain gaseous pressure without increasing the cost of the closure.

BREIF DESCRIPTION OF THE DRAWINGS

DETAILED DESCRIPTION OF THE DRAWINGS

Figure 1:
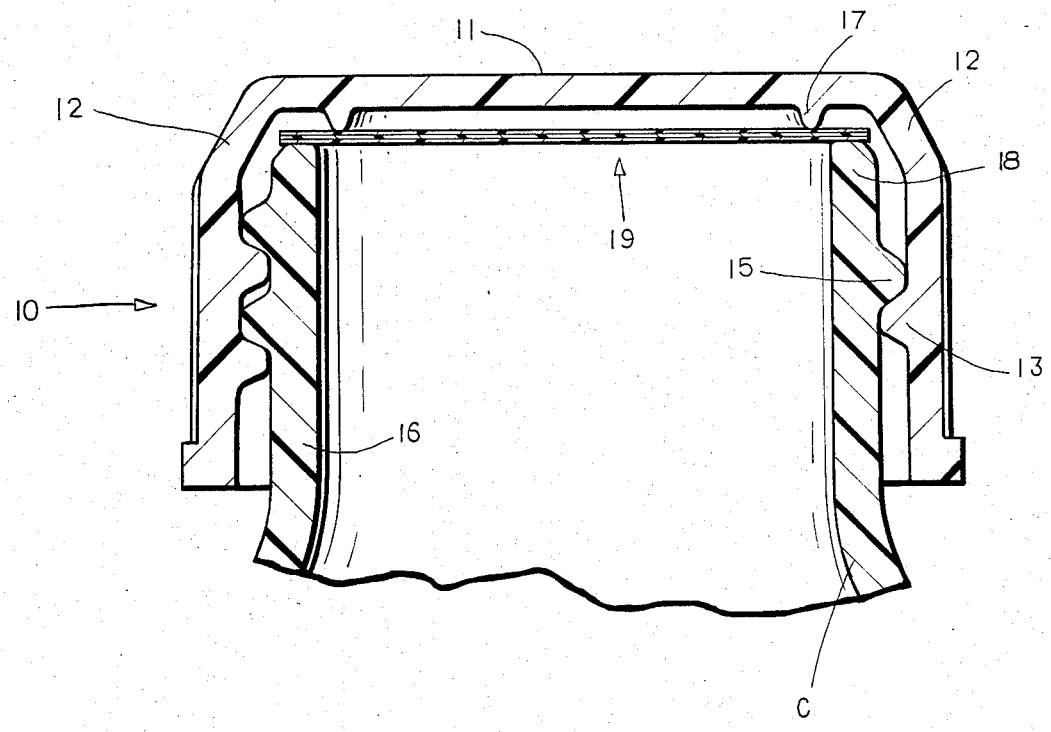
FIG. 1 is a vertical, cross-section through a closure system of the invention.
Figure 2:
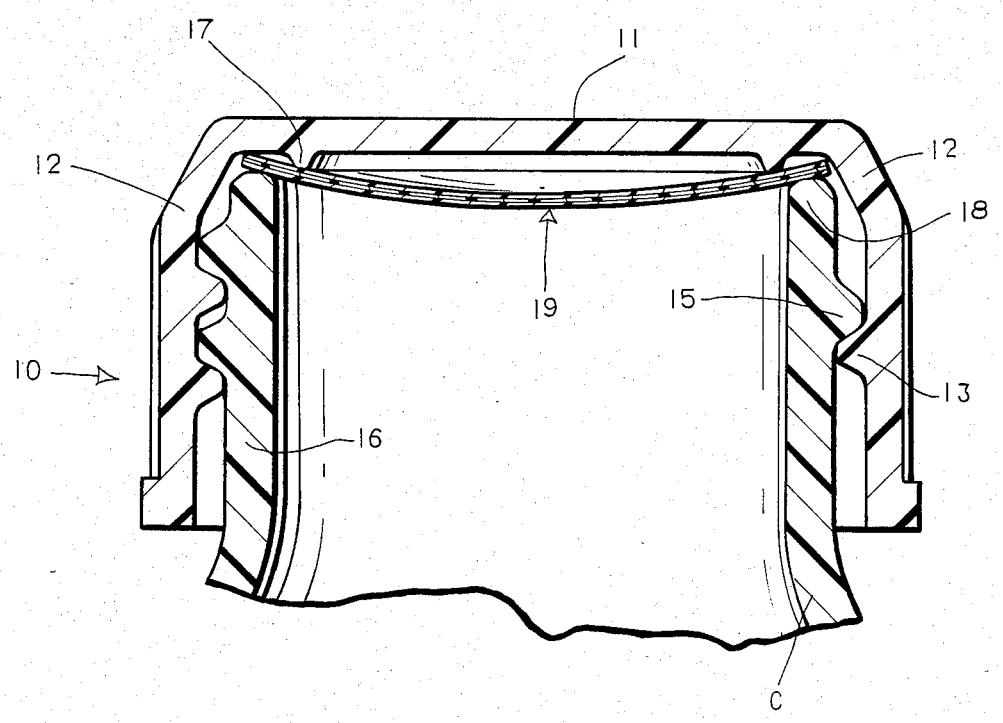
FIG. 2 is a view similar to that of FIG. 1 showing the closure system in the sealing position.

With particular reference to the embodiment shown in FIGS. 1 and 2, a plastic cap or closure 10 is formed with a generally horizontal top wall 11 and tapered corners 12 joined to an annular skirt 13. The skirt 13 has an external configuration that may include friction gripping zones, such as knurling or ribs, for assisting in twist removal of the cap from a container "C". Additionally, the skirt is formed with internal threads 14 which cooperate with threads 15 formed on the neck 16 of the container "C".

Internally of the wall portion 11 there is provided an annular, depending ringlike formation 17 which extends below the inner wall of the outside closure 10. As can be seen when viewing FIGS. 1 and 2, the ringlike formation 17 has a diameter somewhat less than the inside diameter of the neck 16 of the container "C". The upper edge of the neck 16 or finish of the container "C" presents a rounded sealing surface 18. Between the sealing surface 18 and the ringlike formation 17 is positioned a sealing disc 19. The disc 19 may be composed of three layers of plastic material with the bottom-most layer being a somewhat soft material which has good deformation and sealing characteristic. The intermediate layer will be a material having good mechanical strength and the upper layer will be formed of a gas barrier material such as "Eval". The position of the disc 19 as shown in FIG. 2 is just after the cap is threaded down tightly and illustrates that there will be a downward deflection of the center portion of the disc due to the engagement of the ring 17 against the upper surface of the disc at a position inside of the upper sealing surface 18 of the container neck 16. With the closure applied to a container which is not subject to internal pressure, the disc 19 would generally assume that configuration shown in FIG. 2. However, once applied, and assuming the container holds a carbonated soft drink which generates pressure, the disc 19 would be subjected to pressure therebeneath. Depending upon the relative rigidity and elastic recovery of the disc, it will tend to assume a generally horizontal configuration such as that shown specifically in FIG. 1. Thus it can be seen with the application of the closure embodiment in FIGS. 1 and 2 that the sealing disc concept will increase its sealing properties upon the action of internal pressure acting against the under side of the disc. Initially, the sealing disc is bent by the finish and the ring at the inner top of the cap into a convex inward direction and the elastic recovery force provides sealing force between the disc and the top surface 18 of the container neck 16. Under internal pressure, the disc will be subjected to a bending moment forcing the disc to bend in the opposite direction and resulting in an increase in the sealing force of the disc against the container neck.

Since the outer cap is not pressurized directly, there is little tendency of the top of the outer cap to dome as is the case in many of the present caps. As previously explained, the disc 19 can be made of a multi-layer plastic sheet and each individual layer can consist of a specific material to maximize the desirable performance. As explained, a soft material can be used in the bottom layer to improve the sealing between the disc and finish while a high gas barrier material such as "Eval" may be used in the top layer. The use of a high gas barrier material in the top layer provides an $O_2$ and $CO_2$ barrier without exposing the barrier material to high moisture which tends to reduce the gas barrier properties of "Eval". Furthermore, the thickness of the disc can be adjusted to provide the suitable level of elasticity needed, depending upon the size of the cap or size of the disc and the degree of internal pressure to which the cap may be exposed. Furthermore, to prevent pressure buildup between the disc and the top of the cap, it may be desirable to provide vents in the top cap, although it is unlikely that an significant buildup of pressure would occur.

Figure 3:
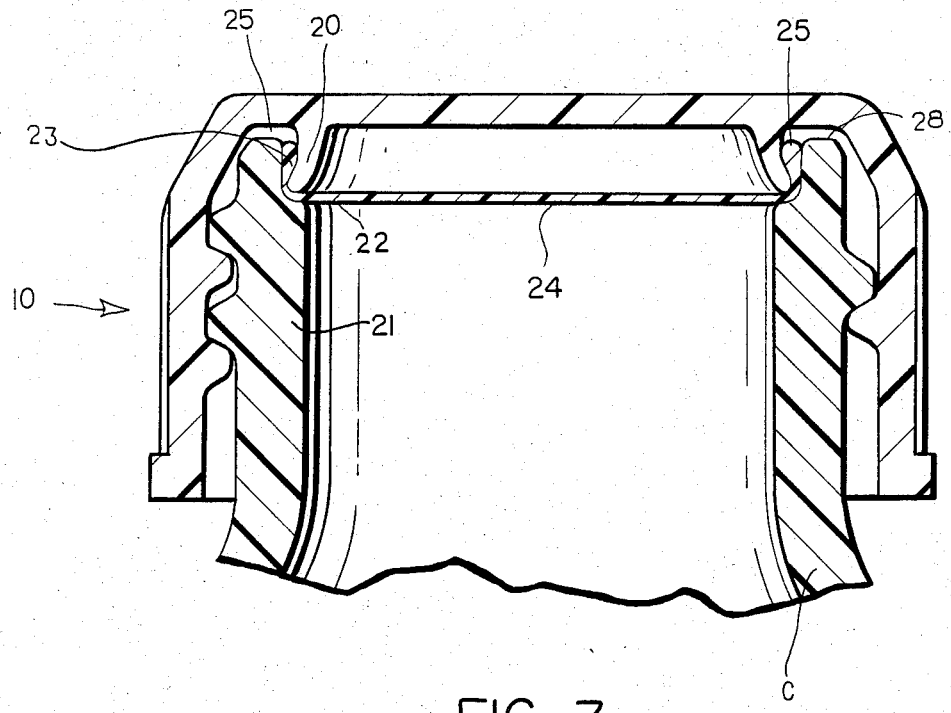
FIG. 3 is a vertical, cross-sectional view through a second embodiment of the closure system of the invention.

Turning now to the embodiment of FIG. 3, it can be seen that the closure or cap 10 is formed with an internal downwardly and outwardly extending annular member 20. In this embodiment, a container "C" has a neck 21 which is formed with an internal ledge 22 which meets a generally downwardly extending inner, cylindrical surface 23. The surface 23 merges at its upper end with the top of the finish of the container. As can be seen when viewing FIG. 3, the annular member 20 extends at an outward angle relative to the surface 23 of the container forming therebetween a V gap. The lower end of the member 20 is adapted to seal against the ledge 22 of the container and a sealing gasket or member 24 interposed therebetween. The member 24 is formed with an enlarged annular ring-like outer edge 25. The gasket or sealing member 24 is placed over the upper surface of the finish of the container, and when the cap is threaded down onto the container into sealing engagement with the ledge 22, the ring-like annular portion 25 of the gasket 24 will be trapped in the previously described V-shaped annular area extending between the member 20 and the inner surface 23 of the finish of the container. When internal pressure is exerted from the contents of the container against the underneath of the gasket or sealing member 24, tending to push the center of the member 24 upwardly as viewed in FIG. 3, the resultant forces are such that the ring-like annular seal 25 is pulled downwardly into the V-shaped area. Thus, with internal pressure acting on the member 24, the sealing effect of the gasket is increased as well, assuring a complete and effective seal being produced between the cap 10 and the container "C".

Figure 4:
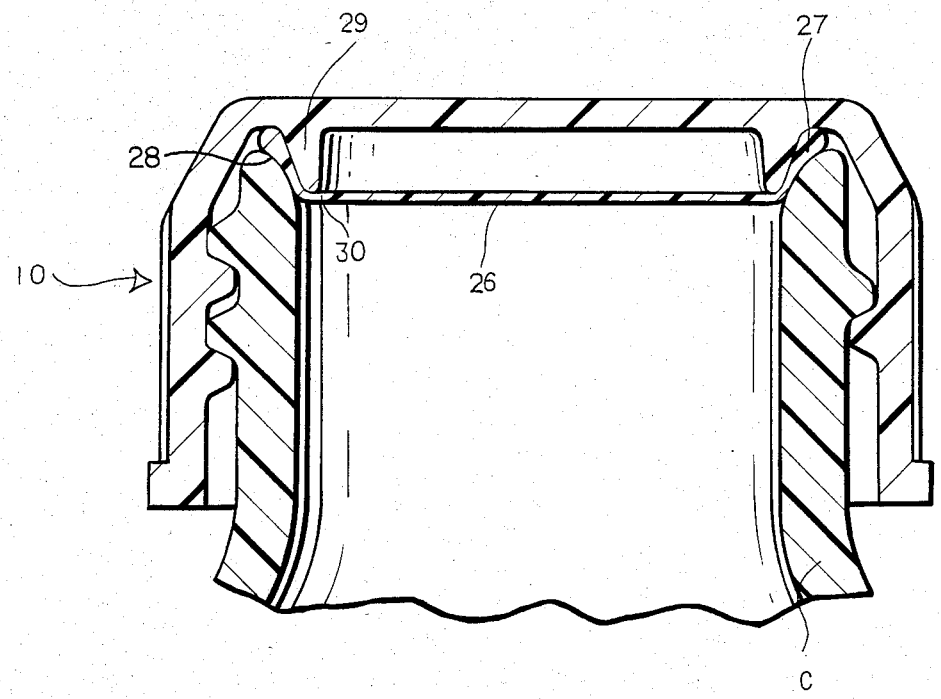
FIG. 4 is a vertical, cross-sectional view through a third embodiment of the invention.

In the generally similar configuration of FIG. 4, a disc or sealing member 26 having an enlarged annular edge portion 27 is intended to be positioned adjacent the upper surface 28 of the bottle finish. In this embodiment, the cap 10 is provided with generally cylindrical downwardly extending member 29 which has a rounded lower surface 30. The cylindrical member 29 has an outer diameter slightly less than the inner diameter of the finish of the container. In this embodiment of FIG. 4, the annular enlarged ring-like portion 27 of the disc or sealing member 26 is held between the member 29 and the bottle finish 28. Here again, when an internal pressure is present against the bottom of the sealing member 26 tending to push the member upwardly, the annular edge 27 will be pulled inwardly resulting in an increased sealing force being exerted between the finish 28 and the sealing member edge 27.

The permeability of plastics that are used for closures is demonstrated by the following table, where the gas barrier properties for a number of plastics at the temperature of 25° C. while dry is given. Both the oxygen and carbon dioxide barrier properties are listed, along with the "Modulus of Elasticity".

| | cc(stp) · mil/100 in$^2$ · day · atm Kpsi | | |
|---|---|---|---|
| Name | $O_2$ | $CO_2$ | E |
| Polyacrylonitrile | .033 | .20 | 550 |
| Polyvinylidene chloride | .885 | 2.39 | 70 |
| Polyethylene terephthalate | 5.85 | 28.64 | 400 |
| Nylon-6 | 6.35 | 26.65 | 400 |
| Polyvinyl chloride | 7.52 | 27.05 | 450 |
| Polyethylene (HD) | 66.8 | 300.6 | 160 |
| Polyvinyl acetate | 83.5 | 250. | 30 |
| Polypropylene | 367.4 | 1543. | 150 |
| Polystyrene | 439.2 | 1669. | 350 |
| Polyethylene (LD) | 484.0 | 1937. | 50 |
| Polycarbonate | 234.0 | 1336. | 1250 |
| EVAL-F | .012 | .046 | 305 |
| EVAL-E | .12 | .41 | 250 |

Figure 5:
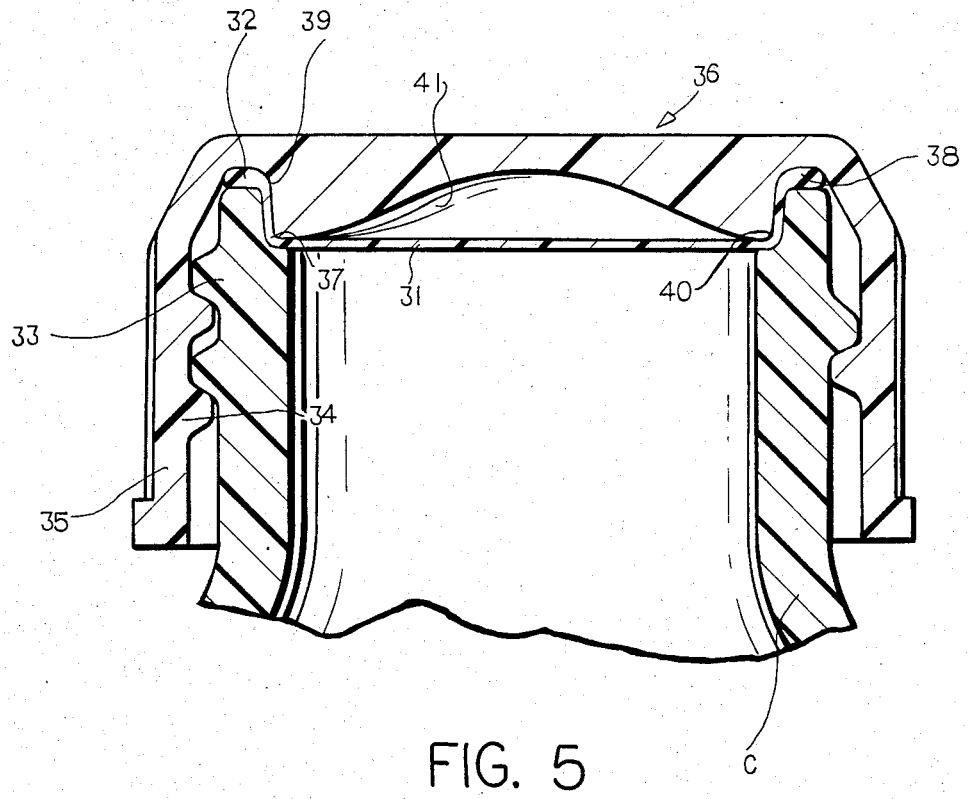
FIG. 5 is a vertical, cross-sectional view through a fourth embodiment of the invention.

The fourth embodiment of the invention illustrated in FIG. 5 shows a sealing member or disk 31, similar to that shown in FIG. 4 and having an enlarged rim portion 32. The container finish "C" has external threads 33 which cooperate with internal threads 34 on the skirt 35 of a closure generally designated 36.

It should be pointed out that the finish "C" of the container has an inwardly extending annular ledge 37, located below the top surface 38 thereof. The closure 36 has a generally planar upper surface with the inside of the top having a configuration with a downwardly extending annular wall portion 39 that terminates in an annular shoulder 40. The shoulder 40 blends in with a dome-shaped hollow 41 formed in the under surface of the closure 36 and when the closure is assembled on the finish "C" of the container with the sealing member 31 interposed, the shoulder 40 will bear against the ledge 37 and the enlarged edge 37 of the member 31 will be compressed against the top, rim surface 38 of the container finish "C".

When the pressure that is present in the sealed container is exerted on the sealing member formed of a barrier plastic with the liquid resistant surface as previously described, the member 31 may flex upwardly and be positioned within the dome 41 while the seal at the edge 32 may be enhanced, since the space between the closure and the container finish is less along the wall portion 39, and any tendency of the member 31 to pull will increase the effectiveness of the seal between the container and closure.

What is claimed:

1. A plastic closure system for containers holding liquids under internal pressure, which provides good sealing and gas barrier properties, comprising a generally circular sealing member formed of at least two superimposed layers of different resins, said sealing member having a diameter larger than the inner diameter of the container inner neck wall, a plastic overcap, said overcap having an integrally formed, annular member extending downward from the inner top wall thereof, said annular member having a diameter less than the topmost portion of the container inner neck wall, said container inner neck wall formed with a radially inwardly extending annular ledge spaced below said topmost portion of said container neck, said ledge in said container neck and the lower edge of said annular member adapted to sealingly engage an annular portion of said sealing member positioned therebetween.

2. The closure system of claim 1 wherein a first, inner layer resin provides mechanical strength and is of the greater thickness and the second, upper layer is a high gas barrier resin.

3. The closure system of claim 2 wherein said sealing member is formed with a third layer of resin, said third layer being formed of a soft material which will conform to the upper finish of the container and seal thereto.

4. The closure system of claim 1 wherein said sealing member is formed with an upper layer of a gas barrier resin and a bottom layer, that is exposed to the liquid in said container, formed of a polyethylene, polypropylene or polystyrene resin.

5. The closure system of claim 1 wherein said sealing member is formed with an integral, peripheral edge of enlarged cross-section, said peripheral edge of said sealing member being trapped between said overcap and container neck at a zone above the sealing engagement area of the overcap annular member and the annular ledge wherein internal pressure acting upon the inner surface of said sealing member will tend to draw the edge of the sealing member into greater compression between the cap and ledge.

6. The closure system of claim 5 wherein said sealing member is formed with an upper layer of a gas barrier resin and a bottom layer, that is exposed to the liquid in said container, formed of a polyethylene, polypropylene or polystyrene resin.

7. A plastic closure system for containers holding liquids under internal pressure, which provides good sealing and gas barrier propertiies, comprising a generally circular sealing member formed of two superimposed layers of different resins, said sealing member having a diameter larger than the inner diameter of the container inner neck wall, a plastic overcap, said overcap having an integrally formed, annular member extending downward from the inner top wall thereof, said annular member having a diameter less than the topmost portion of the container inner neck wall, said container inner neck wall being formed with an inwardly and downwardly tapering inner surface extending from said topmost portion of said container neck, said inwardly tapering surface and said annular member adapted to sealingly engage an annular portion of said sealing member positioned therebetween, said annular portion of said sealing member being formed with a thicker outer rim area adapted to be compressed between said annular member and said tapering surface of said inner container neck wall.

8. The closure system of claim 7 wherein said sealing member is formed with an upper layer of a gas barrier resin and a bottom layer, that is exposed to the liquid in said container, formed of a polyethylene, polypropylene or polystyrene resin.

9. A plastic closure system for containers holding liquids under internal pressure, which provides good sealing and gas barrier properties, comprising a generally circular sealing member formed of two superimposed layers of different resins, said sealing member having a diameter larger than the inner diameter of the container inner neck wall, a plastic overcap, said overcap having an integrally formed, annular member extending downward from the inner top wall thereof, said annular member having a diameter less than the topmost portion of the container inner neck wall, wherein said container inner neck wall is formed with a vertical, cylindrical wall portion extending from the top of the neck and terminating in a radially inwardly extending ledge, said annular member of said overcap extends downwardly and outwardly with its lower end adapted to engage said ledge in said neck wall adjacent the cylindrical wall portion and said sealing member formed with an enlarged annular rim portion, said rim portion adapted to be positioned between said annular member of said overcap and the inwardly tapering surface of said container inner neck wall when said sealing member is interposed said annular member and said ledge.

10. The closure system of claim 9 wherein said sealing member is formed with an upper layer of a gas barrier resin and a bottom layer, that is exposed to the liquid in said container, formed of a polyethylene, polypropylene or polystyrene resin.

* * * * *